US005344141A

United States Patent [19]

Smith

[11] Patent Number: 5,344,141

[45] Date of Patent: Sep. 6, 1994

[54] PUTTER

[76] Inventor: James D. Smith, 509 Parlem Dr., Chattanooga, Tenn. 37415

[21] Appl. No.: 44,641

[22] Filed: Apr. 8, 1993

[51] Int. Cl.[5] ..... A63B 53/02

[52] U.S. Cl. ..... 273/80.2; 273/80 C; 273/167 G

[58] Field of Search ..... 273/77 R, 164.1, 167 R, 273/167 A, 167 C, 167 D, 78, 167 F, 169, 167 G, 80 R, 80 C, 80 A, 167 J, 80.2, 80.1; D21/217

[56] References Cited

U.S. PATENT DOCUMENTS

| | | | |
|---|---|---|---|
| 202,504 | 10/1965 | Citro . | |
| D. 204,002 | 3/1966 | Tanis et al. . | |
| D. 264,366 | 5/1982 | Roskopf et al. | D21/217 |
| D. 313,057 | 12/1990 | Gebhardt | D21/217 |
| 1,703,199 | 2/1929 | McClure | 273/167 G X |
| 3,062,549 | 8/1960 | Duden | 273/81.3 |
| 3,758,115 | 9/1973 | Hoglund . | |
| 3,762,717 | 10/1973 | Johnston | 273/167 |
| 3,770,279 | 11/1973 | Phinny | 273/167 |
| 3,874,668 | 4/1975 | Flege | 273/81.3 |
| 3,917,277 | 11/1975 | Beck et al. | 273/77 R X |
| 3,989,257 | 11/1976 | Barr | 273/80 C X |
| 4,121,833 | 10/1978 | Prueter | 273/175 |
| 4,138,117 | 2/1979 | Dalton . | |
| 4,227,694 | 10/1980 | Drake . | |
| 4,330,128 | 5/1982 | Morelli | 273/173 |
| 4,702,477 | 10/1987 | Solomon | 273/80 C |
| 4,871,174 | 10/1989 | Kobayashi | 273/167 H X |
| 4,964,639 | 10/1990 | Tucker | 273/167 G X |
| 4,966,369 | 10/1990 | Griffin | 273/80 |
| 5,160,141 | 11/1992 | Crews | 273/80 C X |

*Primary Examiner*—Sebastiano Passaniti
*Attorney, Agent, or Firm*—Luedeka, Neely & Graham

[57] ABSTRACT

Disclosed is an improved putter for use in the game of golf. The improved putter of the present invention includes a putter face defining a generally planar contact surface. Attached to the rear of the putter face is an elongate putter barrel defining a barrel axis passing through the center of the barrel aligned perpendicular to the planar contact surface. A connector is provided on the barrel to allow for connection of the putter barrel to a putter shaft. Thus, the shaft may gripped by a user in order to initiate motion of the putter face and barrel. The connector and shaft are preferably provided so that the moment of inertia about an axis passing through the center of the shaft is increased, thereby resisting rotation about the axis of the shaft. Further, in a preferred embodiment, the connector is attached to the barrel along the barrel axis so that any force transferred to the putter barrel and face through the shaft is transferred along the barrel axis, further reducing the tendency of the putter face to rotate about the shaft axis. Additionally, the shaft of the putter is angled toward the putter face which increases the tendency to accelerate the putter head through impact with the golf ball.

9 Claims, 2 Drawing Sheets

PUTTER

FIELD OF THE INVENTION

This invention relates to the field of golf equipment and, particularly, to an improved putter for use in the game of golf.

BACKGROUND OF THE INVENTION

As is well known, the game of golf consists of two primary phases of the game, first phase, often called "tee to green" includes approaches to the green which typically involve using a club which strikes a golf ball so that it flies through the air toward the green. Once the green has been reached, the second phase of the game is entered which includes putting the ball to the hole. Putting is a completely different type of action from the approach to the green, since the ball typically is rolled along the surface of the green toward the hole. Additionally, while the hole remains the target throughout the game of golf, the approach shots typically have a much larger target the green instead of the hole, or cup, itself. Once on the green, putting involves a much higher degree of accuracy than the approach shots because the target has now been reduced from a relatively large green to a cup only 4.25 inches in diameter.

In recognition of these two distinct phases of the game, over the years the club used for the putting phase, the putter, has become highly evolved and substantially different from clubs used in the other phases of the game. However, all of the evolutions of the putter have been designed to increase the accuracy of a putt so as to increase the likelihood that the ball will be struck into the hole.

The act of putting requires a coincidence of two primary elements in order for a putt to go into the cup. The first element is direction, or proper alignment of the putter, so as to strike the ball along a path which will intersect the cup. The second element, speed, includes striking the ball with the proper force so that the ball travels the proper distance along the desired line so that it reaches the cup, but not so hard that it rolls over the cup or through the desired path. Typically, the directional element has not been emphasized in prior art putters, and in fact, the most recent developments in putter design have centered about mass distribution in the putter head to minimize the effect of off center contact between the putter and the ball so that the ball travels an improved distance even though mishit, in effect minimizing the loss of distance in off center contact. Direction has not been emphasized in most prior art designs. In fact, the typical putter is shafted at one side of the putter head which encourages inconsistent directional control since the putter face will tend to rotate relative to the shaft during the putting stroke. To minimize the impact of this tendency, a putting stroke and grip have developed in an attempt to counteract this latent defect in prior designs. However, the stroke and grip result in a loss of feel to the user and a lack of accuracy since the muscles used to grip the putter must be tensed in an attempt to maintain the proper putter face alignment.

With respect to the directional element, there are three primary considerations involved in putting the ball in the proper direction or line. The first consideration is reading of the green to determine the proper line. In reading the green, the slope of the green, the grain of the grass on the green and any other elements which may cause the ball to deviate from a straight line path to the cup must be considered and then a line selected to compensate for these factors. Obviously, the reading of the green cannot be achieved by a putter; however, once the line is selected, the golfer must then align the putter so that the ball will be struck along the proper line which is the second consideration of the directional element. Typical prior art putters are very difficult to align with the ball as there are very few meaningful visual cues provided on the putter to indicate how the putter is aligned with respect to the ball. It should be noted that since the cup is a relatively small target even minor misalignments of the putter with respect to the ball will result in a deviation from the desired path and cause the ball to miss the cup. The final consideration in the directional element is maintaining the proper putter alignment during the putting stroke so that the putter is at the same alignment at contact with the ball as it was when the putter was initially aligned. Similar to the consideration of alignment prior to the stroke, prior art putters functionally lacking in this consideration. In fact, the "modern" putting stroke in use today has recognized the general unsuitability of prior art putters in this capacity and a relatively unnatural grip technique and stroke have evolved to minimize the chance of misalignment during the putting stroke. However, the mere fact that these artificial strokes have had to be developed points to the fact that the prior art putters have inherent defects of design. These defects stem primarily from the fact that the shaft of the putter is typically provided at one end of the putter face, in effect providing a hinge about which the putter face will tend to swing open and closed relative to the intended path of the ball; such defects almost ensure that the putter face will not be square at impact without some attempt to hold the face square. Putting consistency varies greatly and is proportionate to the success of the attempt to hold the face square.

For example, the typical grip in use today is very a firm grasp of the putter with very little movement of the wrists, which encourages tensed muscles and a reduction of muscular control or sensitivity. In addition, the "modern" putter stroke has evolved into a stroke wherein the elbows, wrists and waist are held relatively rigid and all of the movement is typically initiated in the shoulders. The goal of this stroke is for the putter to follow a straight line back from the ball during the putting stroke and back through the ball so that the putter face does not become misaligned during the stroke. However, such rigidity in the body and a firm grip typically desensitizes the user for the proper feel of the putt (tense muscles and the resulting reduction of muscular control promote off-line movement), thus making it much more difficult to judge how much force to use in striking the ball and resulting in decreased accuracy of putt, both in speed and direction. This stroke is in contrast to the natural tendency of the body in swinging a golf club to swing the club in an arc, using primarily the hands and the arms and, secondarily, the shoulders. However, the prior art putters have completely ignored this element and provide no assistance, stemming from design configuration, in maintaining alignment at the moment of impact. In fact, such prior art putter designs encourage just the opposite and provide no meaningful assistance in maintaining alignment at the moment of impact.

Thus, there exists a need for a putter, which by its configuration and construction, resists misalignment during the putting stroke and tends to maintain such alignment so that the alignment selected prior to the putting stroke is maintained up to and through contact with the ball.

As was indicated, typical prior art putters have paid very little attention to directional considerations and typically leave that to the golfer's putting stroke and experience, which promotes inconsistent putting performance since the alignment of the putter, at impact, is not inherently predictable due to its design. However, because of the lack of consideration of alignment problems during the stroke, the typical putting stroke has evolved with a very firm grip and a very unnatural body motion, in an attempt to offset the tendency of prior art putters to become misaligned during the putting stroke, which results in less feedback being provided to the golfer through the putter and consequently a reduced feel for the putt. This feedback is very important in judging the proper speed of the putt and developing a feel for when the ball is struck with the proper force.

An additional factor in the speed of the putt is whether contact with the ball occurs at the "sweet spot" of the putter face; contact at the sweet spot results in the ball travelling farther than contact elsewhere on the face. As with other pieces of sports equipment used to strike balls, such as baseball bats and tennis rackets, there is typically an area on the contact surface of such sports equipment known as the "sweet spot" which, when contact is made at this spot, the most efficient transmission of momentum from the piece of equipment to the ball will result. Striking the ball on a spot other than the sweet spot results in less energy being transmitted to the ball and thus the ball travels a lesser and unpredictable distance. The sweet spot of a putter is dependant upon many considerations and in typical prior art putters frequently occurs at a position other than the exact center of the putter face. However, with such variations in the sweet spot, it becomes very difficult for the golfer to judge where the sweet spot of the putter truly is and thus even more difficult to make intentional contact with the sweet spot, since the sweet spot is not where it would perceptually appear to be. The result, is that in a typical putt, the golfer may or may not strike the ball with the sweet spot resulting in a reduced ability to judge the proper force with which to strike the ball. Furthermore, even if the golfer has used the putter long enough to know where the sweet spot of the putter is, often times it is towards the heel or toe of the putter and thus, increases the likelihood of misalignment since the golfer perceptually aligns the putter using the center of the putter as an alignment guide for lack of anything better. Therefore, there exists a further need for a putter in which the sweet spot is located in a known and obvious location which coincides with the aiming axis of the putter.

Finally, typically a prior art putter is frequently shafted at one side of the putter head and frequently at the top of the putter head. This shafting results in a innate tendency to misalign the putt at impact, since the force is transmitted off axis (similar to pushing on one edge of an object and having it rotate instead of moving in a straight line) such shafting makes alignment at impact more difficult and causes further feel inconsistencies making speed more difficult to judge.

It is therefore an object of the present invention to provide a putter with enhanced accuracy and control for putting a golf ball.

It is an additional object of the present invention to provide an improved putter to increase the ability of a golfer to properly align the putter with a desired ball path.

It is a further object of the present invention to provide a putter which resists misalignment of the putter during the putting stroke.

It is yet a further object of the present invention to provide a putter with a known "sweet spot".

It is still a further object of the present invention to provide a putter wherein the "sweet spot" coincides with the aiming axis of the putter.

It is a still further object of the present invention to provide a putter with increased feedback through the putter and up the shaft to provide an enhanced feel for the user, to increase distance accuracy of the putter.

SUMMARY OF THE INVENTION

The above and further objects are realized in a putter made in accordance with a preferred embodiment of the present invention. In the preferred embodiment, there is provided a putter for use in the game of golf to impart motion to a golf ball on a surface. In the preferred embodiment, the putter has a putter face having front and rear surfaces and top and bottom edges. The front surface of the putter face defines a substantially planer contact surface for contacting the golf ball. Connected to the rear surface of the putter face is an elongate putter barrel which defines a barrel axis passing through the center of the barrel along its length. The barrel is disposed relative to the putter face so that the barrel axis is substantially perpendicular to the contact surface and the putter face and putter barrel together comprise a putter head. A connector is attached to the putter barrel at an attachment point for providing a strategic connection point on the putter head. An elongate shaft is also connected to the connector and includes grip and putter ends. The shaft is gripped by a user in order to move the putter head to impart the motion to the golf ball. The connector and shaft are configured with respect to the rest of the putter head so that an axis passing through the center of the shaft does not intersect the center of mass of the putter head.

In a preferred embodiment, the attachment point of the connector is provided along the barrel axis. In this embodiment, the connector and shaft are further configured to provide that the connector conducts motion initiated by a user through the shaft to the putter head substantially along the barrel axis.

In a further embodiment of the present invention, the shaft axis is provided at an angle away from the vertical toward a plane defined by the contact surface of the putter of between about 0° and 10°. In an additional further embodiment, the shaft axis is also provided at an angle with respect to a vertical plane oriented along the barrel axis and perpendicular to the contact surface away from the vertical and toward the user of between about 0° and 30°.

In a further embodiment, the putter barrel is attached to the rear surface of the putter face so that the bottom edge of the putter barrel is aligned with the bottom edge of the putter face and when the putter barrel is allowed to rest on the putting surface, the contact surface of the putter face is consistently provided perpendicular to the putting surface.

BRIEF DESCRIPTION OF THE DRAWINGS

The above and further features may best be understood with reference to following detailed description and the figures in which.

DETAILED DESCRIPTION OF A PREFERRED EMBODIMENT

Figure 1:
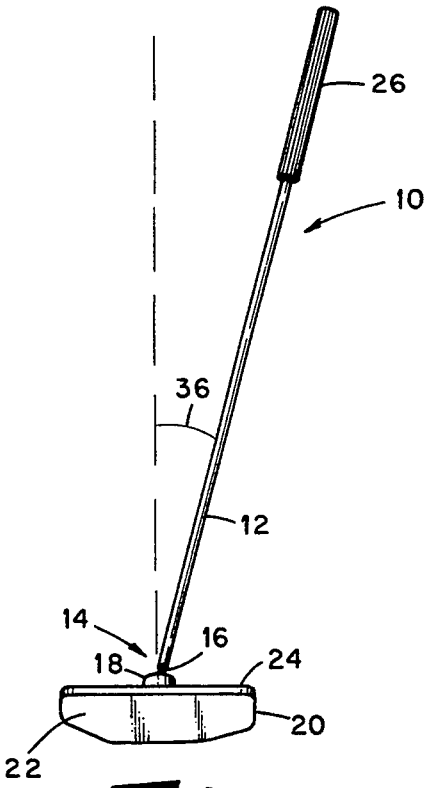
FIG. 1 is a front perspective of a putter.

The following detailed description will be best understood with reference to the FIGURES in which like reference numerals indicate like or corresponding features throughout. There is shown in FIG. 1 an improved putter 10 corresponding to a preferred embodiment hereof. The putter 10 comprises a shaft 12 connected to a putter head 14. In a preferred embodiment, a hosel 16 is provided to allow connection of the shaft 12 to the putter head 14. The putter head 14 comprises a putter barrel 18, preferably about 1" in diameter and preferably between about $1\frac{3}{4}$" to $2\frac{1}{8}$" long, putter face 20 and hosel 16. The putter face 20 has a contact surface 22, preferably about 1" high, 4" wide and $\frac{1}{4}$" thick, and a rear surface 24. As is known in the art, the putter is used by gripping the shaft 10, typically on a grip section 26, and swinging the putter head 14 so that the contact surface 22 strikes a golf ball. The object is to strike the golf ball in such a way so that it rolls across the ground and into a cup.

In the preferred embodiment, the putter shaft 10 is typically of a type well known in the art. The putter shaft 10 may have varying lengths and shapes to accommodate a variety of putting styles. It is a specific feature of the putter 10 of the current application that the putter head 14 of the present invention may be used with any known or anticipated putter shaft 12. Typical shafting techniques such as placing the shaft over the hosel (shaft over technique) or providing a socket on the hosel within which the shaft fits may be used.

Figure 2:
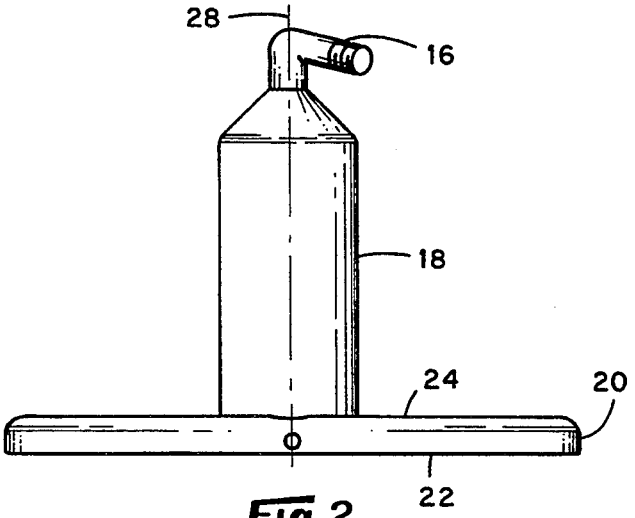
FIG. 2 is a top perspective of a putter head.

Referring now to FIG. 2, the putter head 14 of a preferred embodiment may be described in greater detail. As was described with respect to FIG. 1, the putter head 14 comprises a putter face 20 and a putter barrel 18, connected to the putter barrel 18 connected to a hosel 16 which is further connected to the shaft 12 as shown in FIG. 1. The putter face 20, barrel 18 and hosel 16 may be made of any suitable material such as stainless steel, bronze or aluminum. In a preferred embodiment the putter face 20, the barrel 18 and the hosel 16 are cast as a single piece, most preferably an aluminum bronze alloy. As was described before, the putter face 20 has front and rear surfaces, the front surface being the contact surface 22 and the rear surface 24 being connected to the putter barrel 18. It has been found that a putter head 14 mass of between about 320 to 340 grams is preferred. However, the mass of the putter head 14 may be widely varied to individual subjective desires without departing from the scope of the invention.

As is shown in FIG. 2, the barrel 18 defines a barrel axis 28 which extends through the center of the barrel 18 and through the center of putter face 20. In use, the extended length of the putter barrel 18, provides a strong visual cue of this barrel axis 28 which also coincides with the path a golf ball will take upon being struck by the contact surface 22. In a typical putter, there is no structure corresponding to the putter barrel 18 and thus the direction of travel of the ball upon contact is much more difficult to predict.

Figure 3A:
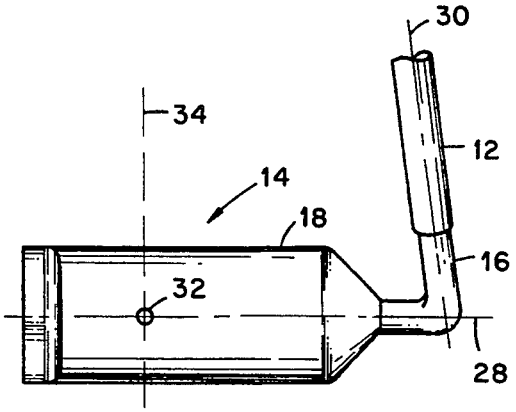
FIG. 3*a* is a side perspective of the putter head.

Referring now to FIG. 3*a*, additional features of the preferred embodiment of the present invention may be described. FIG. 3*a* is a side view of a preferred putter head 14. As is indicated by FIG. 3*a*, in the preferred embodiment, the hosel 16 is connected to the putter barrel 18 at the end of the putter barrel 18 and aligned with the center axis of the putter barrel 18. This arrangement provides that all of the force transferred from the shaft 12 will be directed along the barrel axis 28 to increase the accuracy and control of ball direction. Furthermore, as is shown in FIG. 3*a*, the mounting point of the hosel 16, or the projection 30 corresponding to a projection of the axis of the shaft 12 are provided at a point behind or in front of 32 of the putter head 14; in the case of the preferred embodiment, at a point behind the center of mass 32 of the putter head 14. This configuration provides a greatly increased moment of inertia about the shaft axis 30 than would be the case if the shaft 12 were mounted so that the projection of the shaft 34 were to pass through the center of mass 32.

As physics dictates, the larger the moment of inertia about an axis of rotation the greater the resistance to rotation about that axis. Thus, were a projection of the shaft action 34 to pass through the center of mass 32, the moment of inertia about that rotational axis 34 would be minimized so that the club face would tend to rotate about that axis. However, where the shaft axis 30 is positioned apart from the center of mass 32, as is the case in FIG. 3*a* where the shaft axis 30 is positioned behind the center mass 32, the moment of inertia is much greater and therefore there is a greater resistance to rotation about axis 30 so that there is a reduced likelihood of the putter face 14 rotating about this axis 30. This increase in the moment of inertia about the shaft axis results in the putter face 20 tending to stay square, or aligned with the ball, during the back swing and forward swing of the putter prior to contact with a golf ball. This results in a greatly decreased likelihood of the putter face being opened or closed (off of square) with respect to the ball and thus greatly increases the likelihood that the ball will be struck so that it follows the intended line of travel, in the preferred embodiment, along the barrel axis 28. As is apparent from FIGS. 2 and 3*a*, the result will be that once the barrel axis 28 is aligned with the desired direction of travel of the ball, there is a significantly decreased likelihood that this direction will change through rotation of the putter head by the time the ball is struck.

Figure 3B:
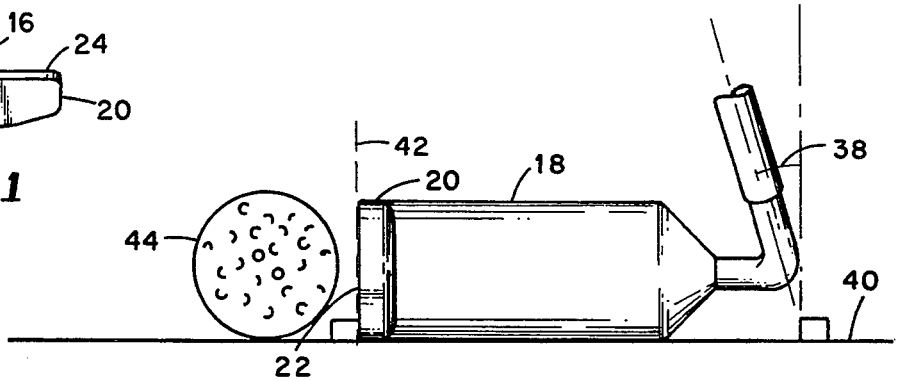
FIG. 3*b* is a side perspective of the putter head prior to a stroke on a golf ball.
Figure 4:
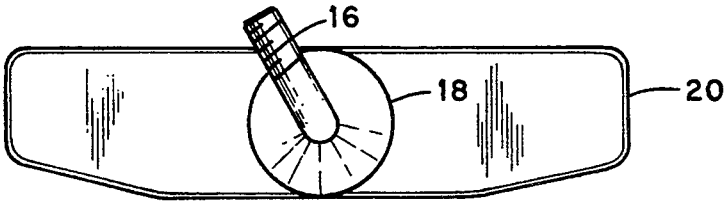
FIG. 4 is a rear view of a preferred embodiment.

Another feature of the preferred embodiment apparent from FIGS. 1, 3*a* and 3*b* is the relative angular relationship of the shaft 12 and hosel 16 with respect to a vertical plane aligned with the barrel axis 28 and a vertical plane aligned with the putter face 22. As is indicated by FIG. 1, the shaft 12 is provided at an angle 36 with respect to a vertical plane aligned with the barrel axis 28. The putter of FIG. 1 is generally configured for a right handed user and angle 36 provides that the shaft is angled towards the user when the putter head is aligned with the ball. This angle 36 is preferably between about 0° and 30° and is most preferably about 15 degrees. This angle 36, when combined with a typical shaft lengths of a putter, provide for the optimum alignment of a user's eyes with the putter head 14 to facilitate aiming along barrel axis 28 and allows for the bottom of the putter head 14 (and barrel 18) to rest squarely on the ground.

Additionally, the shaft 12 or hosel 16 is also provided at an angle 38 with respect to a vertical plane parallel to the plane of the putter face 20. With a typical length putter shaft, this angle 38 is preferably between about 0° and 10° and most preferably about 1 degree. This angular relationship minimizes the impact of bad strokes wherein the user of the putter 10 fails to follow through on the putting stroke after making contact with the ball. A tendency shared by many golfers is to unintentionally decelerate the putter head 14 as it nears or makes contact with the golf ball or when the shaft reaches perpendicular at the bottom of the stroke. The resulting abbreviated stroke, or "jab" as it is commonly called, in most cases drastically reduces the control of distance and direction the golf ball will travel after being struck. However, as provided by the angular relationship 38 of the shaft to a vertical plane parallel to the putter face 20, even if the user decelerates the putter as the shaft becomes perpendicular to the ground at the bottom of the putting stroke, or "jabs" the ball, the contact surface 22 has already struck the golf ball thus minimizing the result of the jab and enhancing the chances that the ball will travel the proper direction and preserve much of the intended distance.

With continued reference to FIG. 3*b*, an additional feature of the putter of a preferred embodiment may be seen. As can be seen in FIG. 3*b*, the lower portion of the barrel 18 is provided so that it coincides with the lower portion of the putter face 20. Thus, once the barrel axis is properly aligned along the desired ball path, merely resting the barrel on the putting surface 40 aligns the contact surface 22 in a generally vertical position. This provides that a plane 42 coinciding with the contact surface 22 will be aligned at substantially a right angle to the putting surface 40. This feature provides that the contact surface 22 will be consistently perpendicular to the ground at contact with a golf ball 44, which increases the tendency of the golf ball to remain on the putting surface 40 as it rolls. When a typical putter is lined up behind the golf ball, the plane coinciding with the contact surface generally has some loft which provides that the angle between the plane of the contact surface and the putting surface 40 is generally greater than 90°. Unless compensated for, this loft at impact tends to lift the golf ball from the putting surface and imparts various amounts of backspin which forces the ball to skid longer before starting to roll forward, in turn reducing the likelihood that the ball will travel the desired distance and along the desired path. Additionally, should the user try to compensate for the loft inherent in a typical putter face, the user will have to concentrate on correcting for the loft as well as the direction and speed of the putt, thereby increasing the likelihood that the user will not putt the ball along the desired path or with the desired speed (this further results in inherent inconsistencies in putting with a conventional putter).

Figure 5:
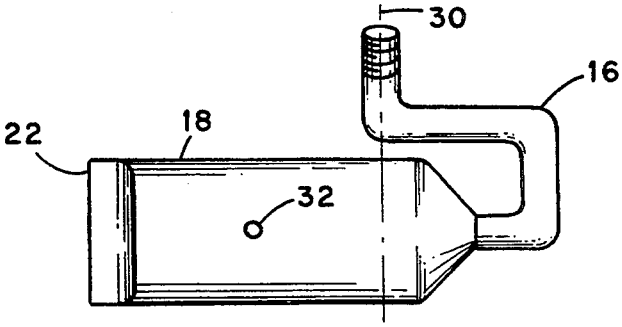
FIG. 5 is an alternative embodiment of a putter head.

Referring now to FIG. 5, a putter with a modified hosel 16 is shown. The putter head 14 of FIG. 5 otherwise corresponds to the putter heads shown in FIGS. 1–3*b*. FIG. 5 illustrates that a variety of shafting techniques and hosel shapes may be provided with respect to the putter 10 of the preferred embodiment, but that in any embodiment, the projection of the shaft axis 30 will not pass through the center of mass 32 of the putter head 14. As is indicated in FIG. 6*b*, an alternative embodiment of the putter head 14, it is even possible that the projection of the shaft axis 30 could pass in front of the center of mass 32 of the putter head 14 without departing from the principal of increasing the moment of inertia about the shaft axis 30. These variations allow for a variety of putters incorporating the improvements hereof, while allowing for differing subjective preferences by users.

Referring primarily to FIGS. 1–3*b*, the benefits of a putter 10 made in accordance with the preferred embodiment of the present invention may be better understood. The act of putting primarily consists of two components, direction and speed. The component of direction generally consists of reading a green to determine the best line of the putt to provide that the ball will intersect the cup and then aligning the putter so that the ball will travel along that line. A putter 10 made in accordance with the preferred embodiment of the present invention greatly increases the likelihood that a user of the putter will indeed properly align the putter head 14 so that the ball travels along the intended path. This directional assistance is primarily provided by the extended shape of the putter barrel 18. In the preferred embodiment, the putter barrel 18 is typically cylindrical and has a width typically about ¼ the width of the putter face 22. In a further embodiment support members may extend horizontally from the barrel along a portion of the width of the rear surface 24 of the face 20 to enhance rigidity of the putter face 20. Thus, the putter barrel 18 provides an extended sight line along the barrel axis 28. The putter face is provided generally perpendicular to the barrel 18 so that a ball struck by the contact surface 22 of the putter face 20 will directed in a line corresponding to the barrel axis 28, which lies congruent with an extended rearward projection of the actual line of roll of the golf ball. In typical prior art putters, no such extended sight line was provided as there was no structure corresponding to a barrel 18. It should be noted that while the barrel 18 of the FIGURES is shown as cylindrical (having a circular cross section) any cross-sectional shape, such as any polygon, could be used as long as an extended sight line is provided.

Furthermore, as was previously described, the location of the shaft 12 with respect to the center of the mass 32 of the putter head 14 greatly decreases the likelihood that the alignment of the putter head 14 will change after the putter head is initially aligned along the desired path. Once the user has determined the desired path and properly aligned the putter, the putter head must be swung. Frequently with prior art putters, the swinging of the putter results in the putter face deviating from the desired alignment, thus causing the ball to follow an improper path. Over the years a wide variety of grip and swing techniques have been developed to prevent misalignment of the putter during the putting stroke. In fact, these techniques have typically emphasized a very firm grip on the putter shaft intended to physically hold to attitude of the face constant along with minimal movement of the user's body, typically rotation from the shoulders, during the stroke. While these techniques do help to prevent the putter from becoming misaligned during the putting stroke, the firmness of the grip greatly reduces the sensitivity of the user to the putter through his hands (the feel) and the shoulders-only movement is very unnatural, as most users would tend to rotate about their waists, and results in a further reduction of sensitivity to the proper "feel" of the putt. The result is that, while the user has a reduced tendency to misalign the putter during the stroke, much of the feedback and natural feel for the stroke is lost, increasing the likelihood of missed putts and decreasing the predictability of putting accuracy. Another putting technique which has developed in response to the inherent lack of putter face control in previous designs, is a stroke in which the wrists are held rigid so that there is no natural hinging motion. However, this technique also reduces feel and results in a lack of predictability in putting accuracy. Both of these techniques result in a tendency to tense the control muscles which further reduces control and accuracy. Furthermore, the user must mentally concentrate on the grip and shoulder movement or wrist rigidity, in addition to the direction and speed of the putt, further increasing the chances of a missed putt by causing mental and physical confusion on the part of the user. Thus, the present putter 10 greatly enhances the likelihood that the golf ball will be struck along the desired line since the tendency of the putter head 14 is to remain in proper alignment almost regardless of the grip or stroke technique. The result is that the user is free to use a comfortable grip and more natural stroke to improve the feel for the stroke and, consequently, accuracy. The accuracy improvement of the present invention is arrived at because of the inherent function due to the design of the putter and therefore, virtually any putting stroke or technique with which a user feels comfortable, will take advantage of the design improvements of the present putter and allow the user to focus upon the putt itself and not compensating for the design defects of the putter.

The second element of putting, speed, relates to the force with which the ball is hit and thereby the distance the ball will travel. As is immediately apparent, even a ball struck along the proper path will not go in the cup if the ball is not struck the proper distance. Although the line of the putt is generally more important than the speed of the putt, since even if the ball is struck too hard, if the path of the ball intersects the cup there is a possibility that the ball will hit the back of the cup and drop into the cup, speed is a very important consideration. A putter made in accordance with the preferred embodiment of the present invention also increases the ability to putt with the proper speed. Initially, as was previously discussed, the user's feel for a putt using the present invention is significantly increased since the user may effectively employ a motion which feels best to him, his most natural stroke, in using the putter. This increased sensitivity provides a user with much more feedback about the contact with the ball through the putter and thus enables the user to get a much greater feel for the proper stroke for varying distances. Furthermore, as the user's confidence increases due to the alignment characteristics of the present putter, the user will be more likely to strike the ball hard enough to reach the cup and will be less concerned with missing the cup and having the ball go beyond the cup. As this confidence level increases, a greater percentage of the user's putts will in fact go into the cup since the user will be likely to use a more aggressive stroke built on the knowledge that the ball will travel on his intended line.

Aside from the confidence and feel considerations, the structural design of the present putter also provides for greater speed control. As is known to user's of golf clubs and putters, every putter has a spot on the contact surface known as the "sweet spot". This "sweet spot" is similar to the sweet spot frequently referred to in baseball bats, tennis rackets and other sports equipment used to strike a ball. The sweet spot is the contact point on the contact surface at which the most efficient energy transfer between the putter and ball will occur. In typical prior art putters the "sweet spot" is frequently in a position other than where it would be expected. Furthermore as the sweet spot was not necessarily located at the center of the putter face, alignment of the prior art putters so that contact was made at the sweet spot could be difficult and inconsistent. With the present putter 10, the sweet spot coincides with the position of intersection of the barrel 18 and putter face 20. Thus, a user will always know where the sweet spot is located and contact with the ball will almost always be made at the sweet spot. Additionally, since the majority of mass of the putter 10 is concentrated along the putter barrel 18, the putter barrel 18 is aligned around the barrel axis 28, the barrel axis 28 coincides with the ball path and force is transmitted along the barrel axis 28, all of the primary variables which contribute to putter alignment and speed are concentrated along the barrel axis 28 which is also aligned with the sweet spot of the putter face. Thus, contrary to many prior art putters, the user of the putter never needs consider these variables aside from aligning the ball with the center of the putter face 22. Further, the natural lines formed by the outside edges of the barrel's silhouette form accurate and easily perceived sighting devices.

A further feature of the present invention which contributes to accuracy and speed of the putt is the fact that most of the mass of the putter head is provided along the putter barrel axis 28, which corresponds to the line of motion of the putt. As was previously described, this mass distribution provides for a coincidence of the sweet spot, the line along which the force from the shaft is transmitted, and the desired path of the putt and further allows the angular momentum of the putter head along the line of motion of the putter during the putting stroke to be maximized (as opposed to the bulk of the mass of the putter head being aligned to one side of the intended line of motion of the ball as is the case in typical prior art putter); i.e. more of the mass the putter is moving along the line of motion, thus resulting in more stability against perturbation. This coincidence of factors once again serves to increase the sensitivity of the user to a putt and thereby increases the accuracy of putts made with a putter made in accordance with the present invention.

Also, as has been recognized, the optimum putting stroke mimics the path of a pendulum swinging. However, as was previously discussed, a variety of techniques have been developed to prevent putter misalignment and prior art putters which require such specialized techniques tend to detract from the pendulum-like motion of a putter stroke. For example a firm grip and movement only from the shoulders discourages a user from swinging the putter in a pendulum like motion. However, since the present putter 10 reduces the need for a firm grip and unnatural swing movement of the body, a more nearly pendulum like stroke may be used with the present putter. Referring to the putter head embodiment of FIGS. 3*a* and 3*b*, a putter made in accordance with the present invention is shown which maximizes the ability to use a pendulum like putter stroke. As was previously discussed with respect to FIGS. 3*a* and 3*b*, the hose 16 is provided such that a projection 30 of the shaft 12 passes behind the center of mass 32 of the putter head 14. Thus, when the putter 10 is swung off the ground, the swing will tend to mimic the action of a pendulum. Thus, a user need only cooperate with the tendency of the putter head 14 to initiate the back swing, stop the back swing at the desired point and cooperate with the tendency of the putter head again to initiate the forward swing, and follow through ball contact to utilize a pendulum like putter stroke. Similar to increasing the moment of inertia around the putter shaft axis, use of a pendulum like stroke minimizes the tendency for the putter line to become misaligned during the stroke because the face does not have the undesirable tendency to open and close.

Figure 6A:
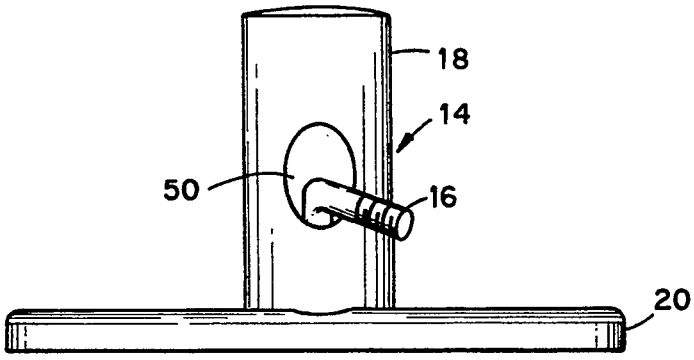
FIG. 6*a* is a top perspective of an alternative embodiment of a putter head.
Figure 6B:
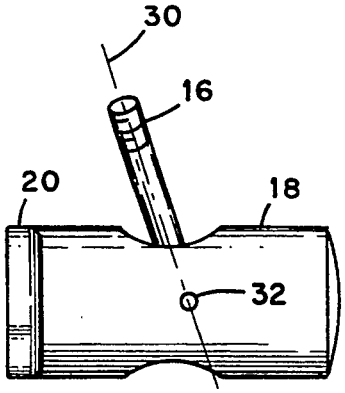
FIG. 6*b* is a side perspective of an alternative embodiment of a putter head.

Referring now to FIGS. 6*a* and 6*b*, one alternative embodiment is shown. As is indicated in FIG. 6*a*, a hole 50 is drilled, machined or cast in the barrel 18. This hole 50 may extend partially through the barrel 18 or, as shown in FIG. 6*a*, completely through the barrel 18. The hosel 16 may then be mounted within the hole 50, and connected to the barrel 18 as was previously described. In accordance with the previous discussions, the hosel 16 is connected so as to intersect with the barrel axis 28 of the barrel 18 although not placed at the end of the barrel 18 as in FIGS. 3*a* and 3*b*. As is shown in FIG. 6*b*, in this embodiment, the projection of the shaft 30 may pass in front of the center of mass 32 to provide a different feel for the putter than would be the case in FIGS. 3*a* and 3*b*. This allows the subjective "feel" preferences of the user to be catered to while still incorporating the desired feel and alignment characteristics as previously described.

Figure 7A:
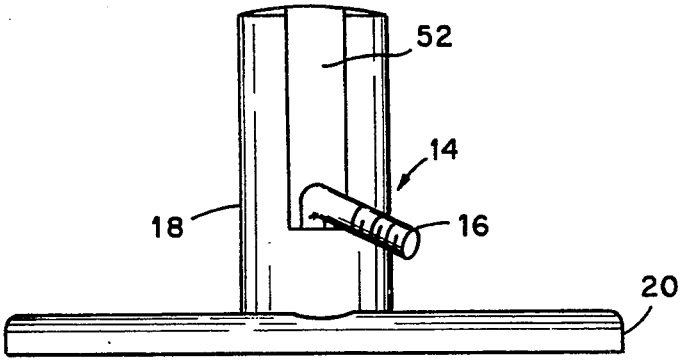
FIG. 7*a* is a top perspective of an alternative embodiment of a putter head.
Figure 7B:
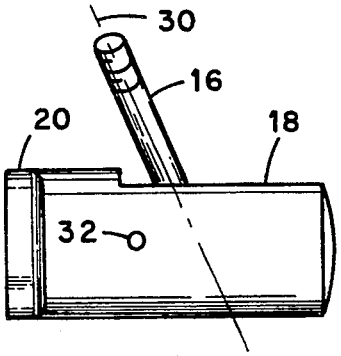
FIG. 7*b* is a side perspective of an alternative embodiment of a putter head.

An additional embodiment is shown in FIGS. 7*a* and 7*b*. In the embodiment of FIGS. 7*a* and 7*b*, a slot 52 is provided along a portion of the barrel 18. As was the case of the embodiment of FIGS. 6*a* and 6*b*, the hosel 16 is still connected to the putter head 14 so as to intersect the barrel axis 28. However, as was the case with the embodiment of FIGS. 6*a* and 6*b*, a projection 30 of the shaft axis still does not pass through the center of mass 32 of the putter head 14. Also, as was the case with the embodiment of FIGS. 6*a* and 6*b*, the barrel 18 still provides an extended sight line for proper alignment of the putter head 14, both at address and impact, and for increased feel. In fact, by varying the length, width and depth of the slot 52, the mass of the putter head 14 and the location of the mass of the putter head 14 with respect to the hosel 16 may be varied to cater to individual preferences of users. However, all such embodiments provide the functional features of increased sight line, resistance to misalignment, position of the sweet spot and other characteristics which increase the user's ability to putt accurately with the present invention.

The foregoing detailed description of a preferred embodiment was for the purposes of illustration and not limitation. As is apparent from the drawings, numerous modifications, additions, substitutions or deletions may be made without affecting the scope of the invention as set forth in the following claims.

I claim:

1. A putter for use in the game of golf to impart motion to a golf ball on a surface comprising:

a putter face having front and rear surfaces and top and bottom edges, said front surface of said putter face defining a substantially planar contact surface for contacting the golf ball;

an elongate putter barrel, having at least a bottom edge, fixedly connected to said rear surface of said putter face and defining a barrel axis passing through the center of said barrel along its length, said barrel disposed with respect to said putter face such that said barrel axis is substantially perpendicular to said contact surface, said putter face and putter barrel together comprising a putter head;

connector means fixedly connected to said putter barrel at an attachment point for providing a connection to said putter head;

elongate shaft means fixedly connected to said connector means having grip and putter head ends and defining a shaft axis generally passing through said shaft for being gripped by a user at said grip end, connected to said connector means at said putter head end and moved by a user to impart motion to said putter head;

said connector means and shaft means being configured to provide that said shaft axis does not intersect the center of mass of said putter head; and said connector means further connected to said putter barrel to impart motion along a line lying within a vertical plane oriented perpendicular to said putter face, passing through said center of mass of said putter head and containing said barrel.

2. The putter of claim 1 further comprising:

said attachment point of said connector means provided to substantially intersect said barrel axis; and said connector means and said shaft means further configured to provide that said connector means imparts motion initiated by a user through said shaft means to said putter head substantially along said barrel axis.

3. The putter of claim 1 wherein said shaft axis is provided at an angle away from vertical toward the plane defined by said contact surface of between about 1 and 10 degrees.

4. The putter of claim 1 wherein said shaft axis is provided at an angle with respect to a plane oriented along said barrel axis and perpendicular to said contact surface away from vertical and toward the user of between about 0 and 30 degrees.

5. The putter of claim 1 wherein said putter barrel is attached to said rear surface of said putter face, the bottom edge of said putter barrel is aligned with the bottom edge of said putter face and when said putter barrel is allowed to rest on the putting surface, said contact surface is perpendicular to the putting surface.

6. A putter for use in the game of golf to impart motion to a golf ball on a surface comprising:

a putter face having front and rear surfaces and top and bottom edges, said front surface and said putter face defining a substantially planar contact surface for contacting the golf ball;

an elongate putter barrel, having at least a bottom edge, fixedly connected to said rear surface of said putter face and defining a barrel axis passing through the center of said barrel along its length, said barrel disposed with respect to said putter face such that said barrel axis is substantially perpendicular to said contact surface, said putter face and putter barrel together comprising a putter head;

connector means fixedly connected to said putter barrel in an attachment point for providing a connection to said putter head;

elongate shaft means fixedly connected to said connector means having grip and putter head ends and defining a shaft axis generally passing through said shaft, for being gripped by a user at said grip end, connected to said connector means at said putter head end and moved by a user to impart motion to said putter head;

said connector means and shaft means being configured to provide that a projection of said shaft axis, to the extent such projection intersects a portion of the putter head, intersects said putter head at a location other than the center of mass of said putter head;

said attachment point of said connector means provided substantially on said barrel axis and said connector means and said shaft means further configured to provide that said connector means imparts motion initiated by a user through said shaft means to said putter head substantially along said barrel axis; and said connector means further connected to said putter barrel to impart motion along a line lying within a vertical plane oriented perpendicular to said putter face, passing through said center of mass of said putter head an containing said barrel axis.

7. The putter of claim 6 wherein said shaft axis is provided at an angle with respect to a plane orientated along said barrel axis and perpendicular to said contact surface away from vertical and toward the user of between about 0° and 30°.

8. The putter of claim 6 wherein said putter barrel is attached to said rear surface of said putter face, the bottom edge of said putter barrel is aligned with the bottom edge of said putter face and when said putter barrel is allowed to rest on the putting surface, said contact surface is perpendicular to the putting surface.

9. The putter of claim 6 wherein said shaft axis is provided at an angle away from vertical toward the plane defined by said contact surface of between about 1 and 10 degrees.

* * * * *